US007844200B2

(12) United States Patent
Kanai et al.

(10) Patent No.: US 7,844,200 B2
(45) Date of Patent: Nov. 30, 2010

(54) IMAGE FORMING APPARATUS WITH A PRE-EXPOSURE LIGHT CONTROL FEATURE

(75) Inventors: Ryosuke Kanai, Numazu (JP); Yosuke Kishi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 197 days.

(21) Appl. No.: 12/172,501

(22) Filed: Jul. 14, 2008

(65) Prior Publication Data

US 2009/0022517 A1 Jan. 22, 2009

(30) Foreign Application Priority Data

Jul. 17, 2007 (JP) ..... 2007-185638
May 30, 2008 (JP) ..... 2008-142353

(51) Int. Cl.
*G03G 21/00* (2006.01)

(52) U.S. Cl. ..... 399/128

(58) Field of Classification Search ..... 399/38, 399/127, 128

See application file for complete search history.

(56) References Cited

U.S. PATENT DOCUMENTS 4,474,455 A * 10/1984 Hirakura et al. ..... 399/128
4,933,721 A * 6/1990 Yasuda et al. ..... 399/128
6,070,032 A * 5/2000 Rokutanda et al. ..... 399/128
6,208,820 B1 * 3/2001 Nami ..... 399/128

FOREIGN PATENT DOCUMENTS

JP 11-174755 A 7/1999

* cited by examiner

*Primary Examiner*—Sandra L Brase
(74) *Attorney, Agent, or Firm*—Fitzpatrick, Cella, Harper & Scinto

(57) ABSTRACT

An inexpensive image forming apparatus, which can suppress a ghost to obtain an image maintaining satisfactory density and gradations for a long time. The apparatus including an electrophotographic photosensitive member, a contact charger in contact with the photosensitive member for charging the photosensitive member, a charging voltage applying device for applying direct current voltage to the contact charger, a charging current detector for detecting electric current flowing through the contact charger, a pre-exposure device for exposing the photosensitive member to light to remove residual charge on the photosensitive member, and a pre-exposure light amount controller for controlling an exposure light amount of the pre-exposure device in image formation based on the results of detection by the charging current detector when the exposure light amount of the pre-exposure device is changed with direct current voltage applied from the charging voltage applying device to the contact charger during non-image formation.

10 Claims, 9 Drawing Sheets

PRE-EXPOSURE LIGHT AMOUNT AND GHOST LEVEL

| | PRE-EXPOSURE LIGHT AMOUNT/(lx·s) | | | | | |
|---|---|---|---|---|---|---|
| | 0 | 3 | 6 | 9 | 12 | 15 |
| DRUM A | × | △ | ○ | ○ | ○ | ○ |
| DRUM B | × | △ | ○ | ○ | ○ | ○ |
| DRUM C | × | × | △ | ○ | ○ | ○ |

○ ; WITHOUT GHOST OCCURRENCE

△ ; WITH MINOR GHOST OCCURRENCE

× ; WITH GHOST OCCURRENCE

IMAGE FORMING APPARATUS WITH A PRE-EXPOSURE LIGHT CONTROL FEATURE

BACKGROUND OF THE INVENTION

1. Field of the Invention

The present invention relates to an electrophotographic image forming apparatus.

2. Description of the Related Art

Conventionally, as an electrophotographic image forming apparatus, there are an electrophotographic copying machine, an electrophotographic printer (such as an LED printer and a laser beam printer), an electrophotographic facsimile machine, and the like.

In image forming apparatuses of these types, a surface of an electrophotographic photosensitive member (hereinafter, referred to as a photosensitive drum or a drum) is evenly charged by a primary charger and the charged photosensitive drum surface is exposed by an exposure device to form an electrostatic latent image. Then, the electrostatic latent image is developed by a developing device to form a developer image (hereinafter, referred to as a toner image). The toner image is transferred by a transfer device onto a recording material such as a sheet. After that, the toner image is fixed by a fixing device onto the recording material as a fixed image to be output. Residual toner remaining on the photosensitive drum surface after the toner image is transferred is cleaned by a cleaning device to be ready for the next image forming operation.

In recent years, a charging device according to a contact charging method is mounted in many image forming apparatuses, and such a charging device is the dominating charging device. In most charging devices according to the contact charging method, a conductive roller is adopted as a contact charging member, and voltage is applied with the conductive roller being in contact with a photosensitive drum, which is referred to as roller charging. The contact charging method is broken down into a direct current method where only a direct current voltage is applied to the contact charging member to charge the photosensitive drum surface and an alternating current superimposition method where direct current voltage with alternating current voltage superimposed thereon is applied to charge the photosensitive drum surface.

In the alternating current superimposition method, there is an advantage that the photosensitive drum surface can be evenly charged. However, since discharge occurs in a minute gap, the photosensitive drum surface is damaged, the amount of wear of the photosensitive drum increases, and the lifetime of the photosensitive drum is shortened.

On the other hand, in the direct current method, compared with the case in the alternating current superimposition method, the energy of discharge which occurs in a minute gap is smaller, so the photosensitive drum is less damaged and the lifetime of the photosensitive drum can be made longer. Therefore, from the viewpoint of increasing the lifetime of the photosensitive drum, it is preferred to charge the photosensitive drum using the direct current method.

However, particularly when the photosensitive drum is charged using the direct current method, there arise the following problems.

The potential of the photosensitive drum surface after an image is formed thereon becomes uneven according to the formed image. Even if the next charge is carried out in this state, charging may not be carried out evenly depending on the image formed last time. As a result, the potential of the photosensitive drum surface exposed by an exposure device, such as a laser, also becomes uneven. In other words, a so-called ghost image may occur. More specifically, when a halftone image is formed after a high-contrast pattern is formed, the so-called ghost image that the previous image pattern emerges in the halftone image may occur.

Therefore, conventionally, a device for exposure before charging having a light source, such as an LED, evenly exposes the photosensitive drum surface to light. This makes even the potential (light section potential) of the image on the photosensitive drum surface when the photosensitive drum surface is exposed by an exposure device and the potential (dark section potential) of the remaining non-image, and thus, an even charge for the next time is made possible and a ghost image is prevented from occurring.

On the other hand, when an image is formed repeatedly for a long time, exposure before charging evenly accumulates charge on the photosensitive drum surface, and a predetermined photosensitive drum light section potential may not be obtained. In other words, the sensitivity of the photosensitive drum may become dull. When the sensitivity of the photosensitive drum becomes dull, there arise problems that a formed image becomes faint and that gradations of an image are lost.

Such deterioration in sensitivity of the photosensitive drum becomes more apparent when the exposure before charging is carried out continuously for a longer time or when the light amount of the exposure before charging is larger.

In Japanese Patent Application Laid-Open No. 11-174755, it is reported that use of a device for exposure before charging for a long time decreases the light amount of the device for exposure before charging. If the light amount of the device for exposure before charging is decreased, the history of a previously-formed image cannot be completely erased, and a ghost image occurs.

Therefore, in order to suppress occurrence of a ghost image and deterioration in sensitivity of the photosensitive drum and to increase the lifetime of the device for exposure before charging, it is necessary to adopt an optimum pre-exposure light amount according to the state of use of the image forming apparatus and variations in manufacture of the pre-exposure light source, such as an LED, and of the sensitivity of the photosensitive drum.

Conventionally, as described in Japanese Patent Application Laid-Open No. 11-174755, control of the exposure light amount in the exposure before charging is carried out according to the relationship between detection by a photosensitive drum surface potential detecting device and electric current applied to the charging device.

However, such a photosensitive drum surface potential detecting device is expensive. Therefore, an image forming apparatus which is less expensive and which can suppress a ghost image and deterioration in sensitivity of the photosensitive drum is desired. In order to attain this, it is necessary to adopt an optimum light amount of the exposure before charging according to the state of use of the image forming apparatus and variations in manufacture of the light source for exposure before charging, such as an LED, and the sensitivity of the photosensitive drum without using a photosensitive drum surface potential detecting device.

SUMMARY OF THE INVENTION

Accordingly, an object of the present invention is to provide an image forming apparatus which is less expensive, which can suppress a ghost image to maintain satisfactory image quality, which can suppress deterioration in sensitivity of an electrophotographic photosensitive member therein as an image bearing member, and with which stable density and gradations can be obtained for a long time.

Further features of the present invention will become apparent from the following description of exemplary embodiments with reference to the attached drawings.

DESCRIPTION OF THE EMBODIMENTS

Exemplary embodiments of the present invention are now described in detail with reference to the attached drawings.

First Embodiment

(1) Image Forming Portion

Figure 1:
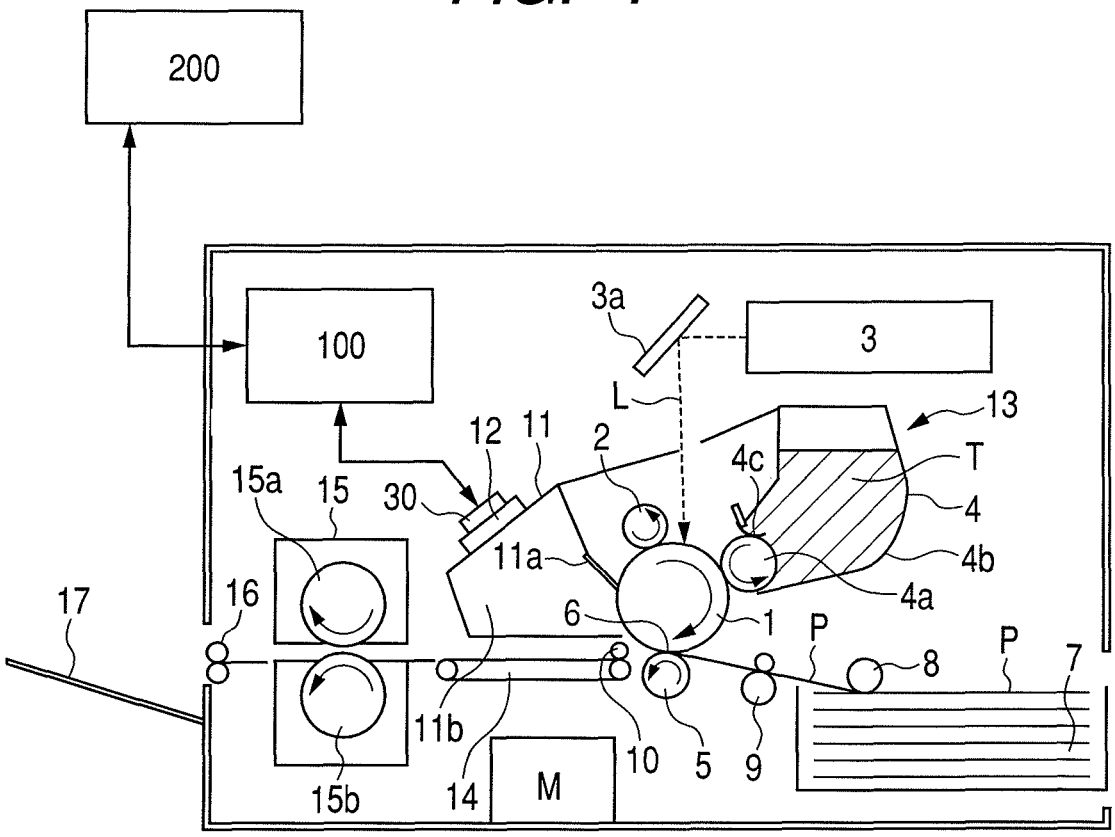
FIG. 1 is a schematic structural view of an image forming apparatus according to a first embodiment of the present invention.

FIG. 1 is a schematic structural view of an image forming apparatus according to a first embodiment of the present invention. The image forming apparatus is an electrophotographic laser beam printer, and, a series of electrophotographic processes, i.e., charging, exposing, developing, transferring, and cleaning are carried out with regard to an electrophotographic photosensitive member of a rotating drum type (hereinafter, referred to as photosensitive drum) 1 as an image bearing member to form an image on a recording material P.

A controller (engine controller: control circuit portion) 100 carries out system control of the whole image forming apparatus. The controller 100 executes an image forming operation based on a print signal which is input from an external host device 200, such as a personal computer, an image reader, or a facsimile machine of the other party. A central processing unit (CPU, not shown) is provided in the controller 100. A series of system processing of the image forming apparatus is carried out according to a program stored in advance in the central processing unit.

Figure 4:
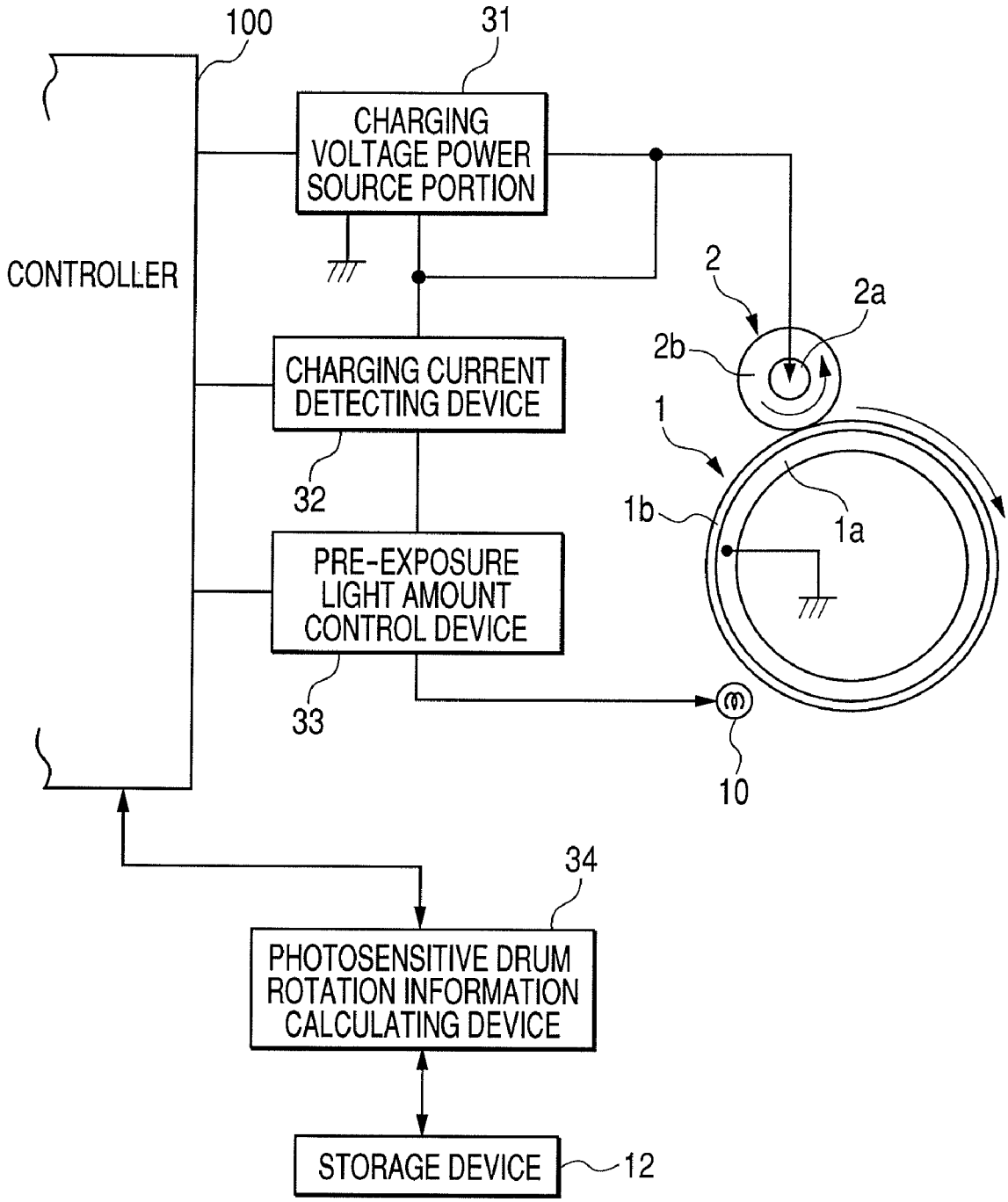
FIG. 4 is a block diagram of a control system of a pre-exposure device.

As illustrated in FIG. 4, in the photosensitive drum 1, a layer of an organic or inorganic electrophotographic photosensitive member (photoconductive material) 1*b* is formed on an outer peripheral surface of a conductive drum base 1*a* made of aluminum or the like. When a main motor M of the image forming apparatus is driven, the photosensitive drum 1 is rotationally driven in a clockwise direction indicated by an arrow at a predetermined speed.

A surface of the rotationally driven photosensitive drum 1 is evenly primarily charged by a charging device at a predetermined polarity and potential. In the present embodiment, the charging device is a roller charging device which uses a conductive roller (hereinafter, referred to as charging roller) 2 as a contact charging member. As illustrated in FIG. 4, the charging roller 2 is formed by forming a conductive elastic layer 2*b* using a conductive rubber material or the like on a conductive core 2*a* in the shape of a roller. The charging roller 2 is disposed so as to be in contact with and in parallel with the photosensitive drum 1, and rotates so as to follow the rotation of the photosensitive drum 1. By applying a direct current voltage of a predetermined polarity and potential to the conductive core 2*a* of the charging roller 2 by a charging voltage power source portion 31 serving as a charging voltage applying device, the surface of the rotating photosensitive drum 1 is evenly charged at predetermined polarity and potential in the direct current method of the contact charging method. In the present embodiment, voltage of −1200 V is applied to the charging roller 2 to charge the photosensitive drum 1 at about −600 V.

Image exposure is carried out by an exposure device with regard to the charged photosensitive drum surface. In the present embodiment, the exposure device is a laser scanner unit 3 including a laser, a polygon mirror, and a lens system. An image signal which is input from the external host device 200 to the controller 100 undergoes image processing by an image processing portion (not shown). The image processing portion controls the laser scanner unit 3 to make the laser output laser light which is modulated according to the image signal. The laser scanner unit 3 deflects with the polygon mirror the laser light which is output from the laser, condenses the light with the lens system onto the generating line of the photosensitive drum 1 via a mirror 3*a*, and scans and exposes to the light (L) the surface of the photosensitive drum 1. This forms on the photosensitive drum surface an electrostatic latent image corresponding to the image signal.

The electrostatic latent image is developed as a developer image by a developing device (developing means) 4 with a developer T. The developer T and the developer image are hereinafter referred to as toner and a toner image, respectively. The developing device 4 includes a developing roller 4*a* for developing the electrostatic latent image, a developing container 4*b* for containing the toner T, and a toner applying member 4*c* for the developing roller 4*a*. The developing roller 4*a* is rotationally driven in a counterclockwise direction indicated by an arrow, and predetermined developing voltage is applied to the developing roller 4*a* by a developing voltage power source portion (not shown).

A transfer device is disposed downstream of the developing device 4 with regard to the rotational direction of the photosensitive drum 1. In the present embodiment, the transfer device is a transfer roller 5. The transfer roller 5 is formed by forming a conductive elastic layer of a conductive rubber material or the like on a conductive core in the shape of a roller. The transfer roller is disposed so as to be in contact with and in parallel with the photosensitive drum 1. The photosensitive drum 1 and the transfer roller 5 are in contact with each other at a transfer portion 6. The transfer roller 5 rotates so as to follow the rotation of the photosensitive drum 1, or, is rotationally driven at a speed which is the same as the rotational speed of the photosensitive drum 1 in the opposite direction to the rotational direction of the photosensitive drum 1 (that is, in the forward direction at a nip of the transfer roller 5 and the photosensitive drum 1).

On the other hand, a sheet feed roller 8 of a sheet feed cassette 7 is rotationally driven at a predetermined control timing. This makes one sheet of recording material (sheet) P stacked in the sheet feed cassette 7 to be separated and fed, and the sheet is supplied to a registration roller 9 in synchronism with formation of a latent image on the photosensitive drum 1. The recording material P is transported to the transfer portion 6 by the registration roller 9 in synchronism with a leading edge of the latent image formed on the photosensitive drum 1. The recording material P is sandwiched and transported through the transfer portion 6. While the recording material P is sandwiched and transported, transfer voltage of a polarity opposite to the polarity of the charged toner and predetermined potential is applied to the transfer roller 5 by a transfer voltage power source portion (not shown). This electrostatically transfers the toner image on the photosensitive drum surface side onto the surface of the recording material P.

The recording material P which goes through the transfer portion 6 is separated from the photosensitive drum surface and is introduced by a transport device 14 into a fixing device (fixing means) 15. In the present embodiment, the fixing device 15 is a heat roller fixing device which has a press-contacting roller pair of a heat roller 15*a* and a pressure roller 15*b*. The recording material is sandwiched and transported by a fixing nip portion which is a press-contacting portion of the press-contacting roller pair 15*a* and 15*b* of the fixing device 15, and the toner image which is not fixed as yet on the recording material is fixed as a fixed image by heat and pressure. Then, the recording material P which goes out of the fixing device 15 is delivered as a print into a delivery tray 17 outside the apparatus by a delivery roller 16.

On the other hand, the photosensitive drum 1 after the recording material is separated therefrom undergoes whole surface exposure (exposure of the whole surface to light) by a pre-exposure device (pre-exposure means) 10 and cleaning by a cleaning device 11 to be ready for repeated image formations.

The pre-exposure device 10 is a device for exposure before charging for making even the potential of the photosensitive drum surface, which has been uneven due to the previous image formation, by the whole surface exposure (exposure of the whole surface to light) of the photosensitive drum surface before the charge of the photosensitive drum 1. More specifically, the pre-exposure device 10 is an eraser means which exposes the photosensitive drum surface to light such that any residual charge on the photosensitive drum surface is removed. As a light source of the pre-exposure device 10, an LED, a halogen lamp, or the like may be used. The light source to be used is not specifically limited, but an LED can be used because its drive voltage is low and, with such an LED, the apparatus can be easily downsized. In the present embodiment, an LED was used as the pre-exposure light source.

The cleaning device 11 is a drum surface cleaning device for removing from the photosensitive drum surface residual contaminants, such as transfer residual toner and paper dust. In the present embodiment, the cleaning device 11 is a blade cleaning device where a cleaning blade (elastic blade) 11*a* as a cleaning member is disposed so as to be opposed to (in the counter direction) and in abutting contact with the photosensitive drum surface for scraping the residual contaminants off the photosensitive drum surface. The residual contaminants which are scraped off are stored in a cleaning container 11*b*.

The pre-exposure device 10 can be disposed downstream of the transfer portion 6 with regard to the rotational direction of the photosensitive drum and upstream of the charging roller 2 with regard to the rotational direction of the photosensitive drum such that the whole photosensitive drum surface may be exposed.

Figure 2:
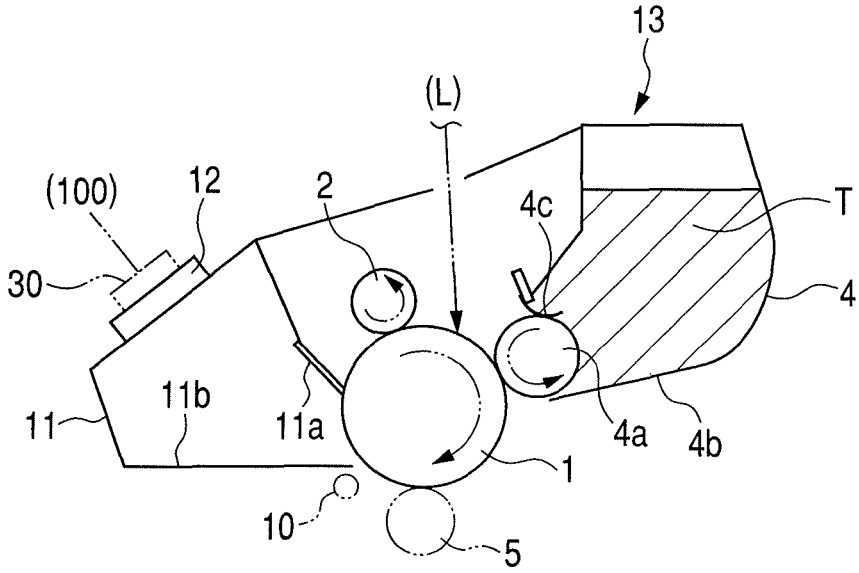
FIG. 2 is a schematic structural view of a process cartridge.

At least some parts of the above-mentioned members constituting the image forming process device may be formed as a process cartridge detachably mountable to a main body of an image forming apparatus. In the present embodiment, four process devices/members of the photosensitive drum 1, the charging roller 2, the developing device 4, and the cleaning device 11 are made into a cartridge 13. FIG. 2 is a schematic structural view of the cartridge 13. The cartridge 13 is a unit into which the above-mentioned four process devices/members are collectively united. These process devices/members are disposed in the cartridge 13 so as to have a predetermined positional relationship with each other. The cartridge 13 can be inserted into and mounted to the main body of the image forming apparatus at a predetermined portion in a predetermined way, and can be detached and removed from the apparatus main body. Further, the cartridge 13 includes a storage device (memory portion) 12 for storing information on the cartridge. When the cartridge 13 is mounted to the main body of the image forming apparatus in the predetermined way, a drive system on the side of the apparatus main body and a driven system on the side of the cartridge are coupled such that the drive system on the side of the apparatus main body can transfer drive power to the photosensitive drum 1, the developing roller 4*a*, and other driven members on the side of the cartridge. Further, a power feed system on the side of the apparatus main body and a power fed system on the side of the cartridge are coupled such that the power feed system on the side of the apparatus main body can feed power to the charging roller 2, the developing roller 4*a*, and other power fed members on the side of the cartridge. Further, a communication device 30 on the side of the apparatus main body and the storage device 12 on the side of the cartridge correspond to each other, and information can be given and received between the controller 100 and the storage device 12 via the communication device 30.

(2) Operation Process of Image Forming Apparatus

Figure 3:
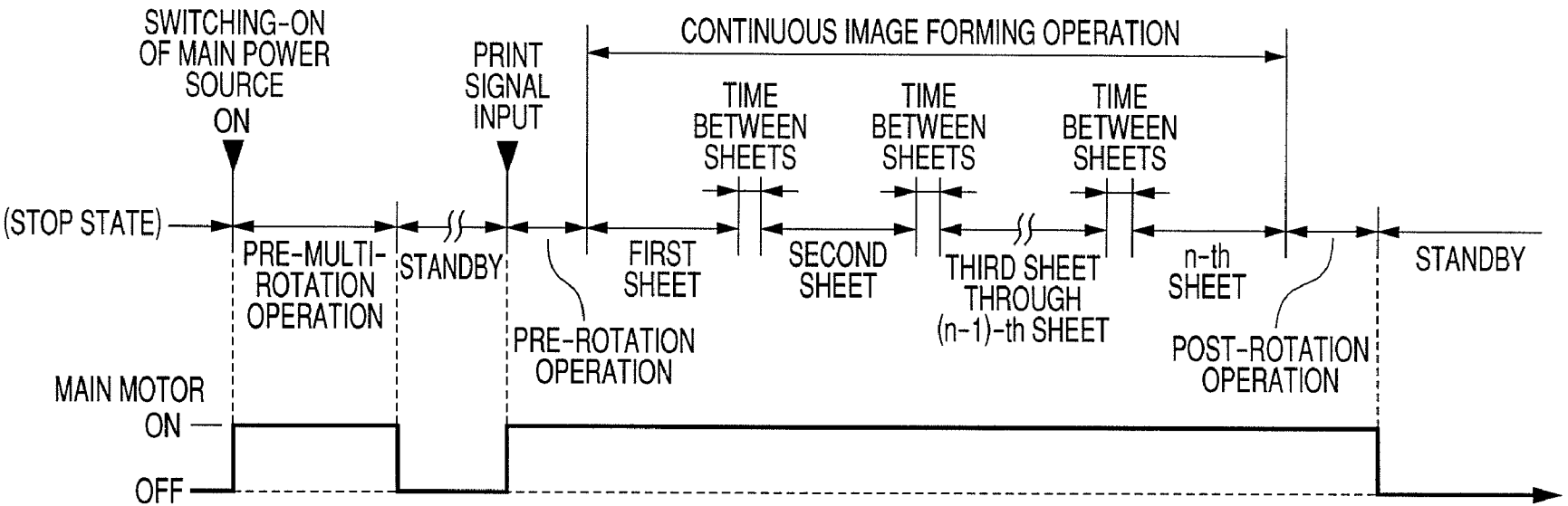
FIG. 3 is an operation process chart of the image forming apparatus.

FIG. 3 is an operation process chart of the image forming apparatus performed by the controller 100.

a) Pre-Multi-Rotation Operation

Pre-multi-rotation operation is an operation at the start of the apparatus, which operation is performed when a main power source switch (not shown) of the image forming apparatus is turned on. The main motor M is actuated to rotationally drive the photosensitive drum, and a predetermined start operation is performed with regard to predetermined process devices.

b) Standby

On standby, after the predetermined pre-multi-rotation operation is completed, the main motor M is stopped, and waits for an input of a print signal (image signal: a request for performing an image formation) from the external host device 200 to the controller 100.

c) Pre-Rotation Operation

A pre-rotation operation is an operation before an image formation, which operation is performed when a print signal is input from the host device 200 to the controller 100. The main motor M is driven to rotationally drive the photosensitive drum 1, and a predetermined operation before an image formation is performed with regard to a predetermined process device. When a print signal is input during the pre-multi-rotation operation, the pre-rotation operation is performed following the pre-multi-rotation operation.

d) Image Forming Operation

An image forming operation is an imaging operation where an image corresponding to image information which is input from the host device 200 to the controller 100 is formed on the recording material P. The image forming operation is performed following an end of the predetermined pre-rotation operation. In a continuous image forming mode, the image forming operation with regard to one sheet of the recording material P is repeatedly performed and the number of repetitions is the same as the number of sheets set in advance on which the image is to be formed.

e) Time Between Sheets

A time between sheets is, in the continuous image forming mode, a time duration from when a rear end of one recording material P passes through the transfer portion to when a leading edge of the next recording material P reaches the transfer portion, in which no recording material is in the transfer portion.

f) Post-Rotation Operation

A post-rotation operation is a post-operation which is performed after the image forming operation is completed with regard to one sheet or a plurality of sheets of the recording material which are set. Even after the image forming operation is completed, the main motor M is driven for a predetermined time duration, and a predetermined completion operation is performed with regard to predetermined process devices.

g) Standby

On standby, after the predetermined post-rotation operation ends, the main motor M is stopped, and input of a next print signal from the host device 200 to the controller 100 is awaited. When the next print signal is input, an operating cycle including the above-mentioned pre-rotation operation, image forming operation, and post-rotation operation is again performed.

In the above-described operation, time periods when no image is formed by the image forming apparatus while the photosensitive drum is rotationally driven occur during the pre-multi-rotation operation, during the pre-rotation operation, during the time between sheets, and during the post-rotation operation.

(3) Pre-Exposure Light Amount Control

Next, a method of controlling a pre-exposure light amount is described. FIG. 4 is a block diagram of a control system of a pre-exposure device 10. The charging roller 2 which is a contact charging member in contact with the photosensitive drum 1 for charging the photosensitive drum 1 is connected to the charging voltage power source portion 31, and direct current voltage of predetermined polarity and potential is applied. This makes the surface of the rotating photosensitive drum 1 evenly charged at a predetermined polarity and potential in the direct current method of the contact charging method. A charging current detecting device 32 for detecting electric current Ic flowing through the charging roller 2 in this case is provided, and further, a pre-exposure light amount control device 33 for controlling output of the pre-exposure device 10 (exposure light amount) based on the results of the detection by the charging current detecting device 32 is provided. The above-mentioned charging voltage power source portion 31, the charging current detecting device 32, and the pre-exposure light amount control device 33 are under the control of the controller 100.

As described above, as the light source of the pre-exposure device 10, an LED, a halogen lamp, or the like may be used. The light source to be used is not specifically limited, but an LED can be used because its drive voltage is low and, with such an LED, the apparatus can be easily downsized. In the present embodiment, an LED was used as the pre-exposure light source. The light amount of the pre-exposure device 10 is variable. In the present embodiment, by varying the voltage (electric current) to be input to the pre-exposure device 10, the light amount is made variable. However, the light amount varying device of the pre-exposure device 10 is not limited thereto, and pulse width modulation (PWM) control or the like may also be used. More specifically, the pre-exposure light amount control device 33 controls the exposure light amount of the pre-exposure device 10 by varying a voltage or an electric current to be input to the pre-exposure device 10. Alternatively, the pre-exposure light amount control device 33 controls the exposure light amount of the pre-exposure device 10 by varying the pulse width of a voltage to be input to the pre-exposure device 10.

Further, as described above, information can be given and received between the controller 100 and the storage device 12 via the communication device 30. Information with regard to rotation time of the photosensitive drum 1 calculated by a photosensitive drum rotation information calculating device 34 on the side of the apparatus main body as part of necessary information is input to the storage device 12, and the information is updated and stored. Further, the information with regard to the rotation time of the photosensitive drum 1 stored in the storage device 12 is read and input to the photosensitive drum rotation information calculating device 34 to be a base of the calculation. It is to be noted that information which is given and received between the controller 100 and the storage device 12 is not limited to the above-mentioned information with regard to the rotation time of the photosensitive drum 1, and other various kinds of information is given and received.

Figures 5, 6:
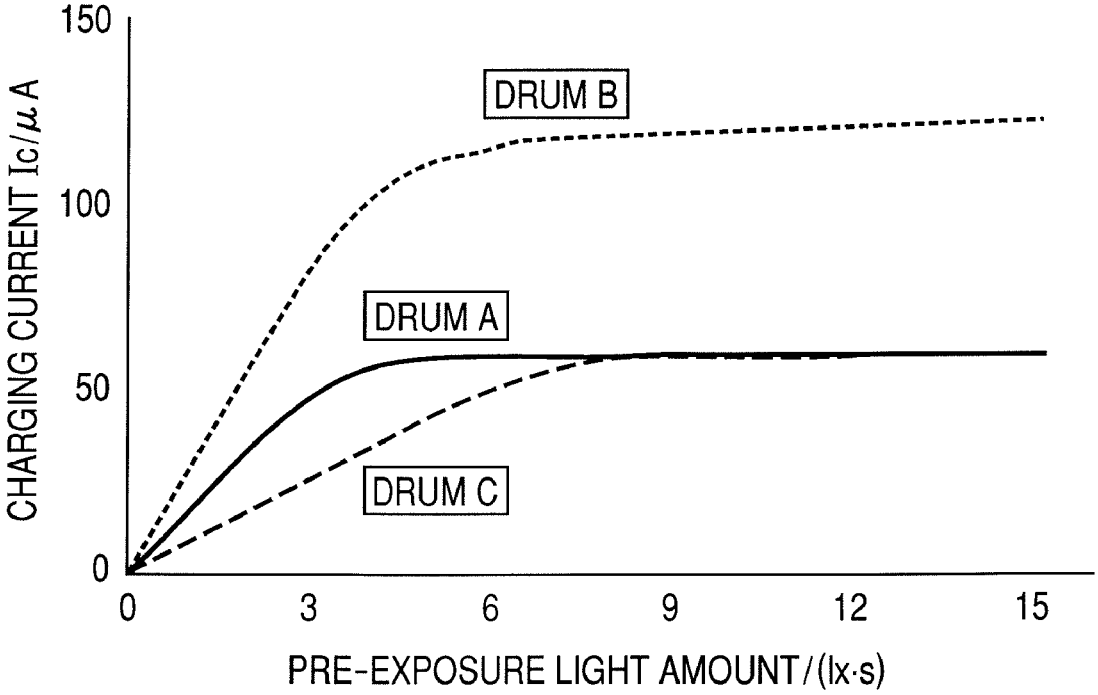
FIG. 5 is a table illustrating the relationship between a pre-exposure light amount and a ghost level.
FIG. 6 is a graph illustrating the relationship between the pre-exposure light amount and charging current.

FIG. 5 illustrates occurrence of a ghost image in image formation with the pre-exposure light amount changed. It is to be noted that the sensitivity of the photosensitive drum 1 was substantially the same, and film thicknesses (thicknesses of the layer of the electrophotographic photosensitive member 1*b*) of photosensitive drums A and B were different (film thickness of A>film thickness of B) while film thicknesses of photosensitive drums A and C were substantially the same and sensitivity of the photosensitive drums A and C were different (sensitivity of A>sensitivity of C). Direct current voltage of −1200 V was applied to the charging roller 2. In FIG. 5, x denotes that a ghost image occurred, Δ denotes that a minor ghost image occurred, and ○ denotes that no ghost image occurred.

As illustrated in FIG. 5, a ghost image can be prevented from occurring when the pre-exposure light amount in the exposure before charge is 6 [lx·s] or more with regard to the photosensitive drums A and B and when the pre-exposure light amount is 9 [lx·s] or more with regard to the photosensitive drum C. More specifically, with regard to the photosensitive drums A and B, the potential of the photosensitive drum surface can be made even by pre-exposure with the pre-exposure light amount of 6 [lx·s] or more, and, with regard to the photosensitive drum C, the potential of the photosensitive drum surface can be made even with the pre-exposure light amount of 9 [lx·s] or more.

FIG. 6 illustrates the relationship between the pre-exposure light amount and charging current in a similar experiment. As the pre-exposure light amount becomes larger, the charging current increases, but when the pre-exposure light amount reaches a certain value or becomes larger, the slopes become smaller. This means that the rate of change of the potential of the photosensitive drum surface becomes lower, and means that the potential of the photosensitive drum surface which was made uneven by the laser exposure (image exposure) L is made sufficiently even by the pre-exposure. More specifically, as a result of determination of the charging current with the pre-exposure light amount gradually increased, it is found that, pre-exposure with the pre-exposure light amount when the slopes of the charging current in FIG. 6 become small can make even the potential of the photosensitive drum surface before the next charge, and thus, a ghost image does not occur.

As illustrated in FIGS. 5 and 6, it is found that, by using the pre-exposure light amount in a range where the slopes of the charging current illustrated in FIG. 6 become small, the occurrence of a ghost image can be suppressed.

Next, continuous printing of 10,000 sheets with the light amount of the exposure before charging being changed was carried out, and photosensitive drum light section potential VL in the laser exposure was determined. It is to be noted that, during the image formation, the exposure before charging was ON all the time, and a photosensitive drum in the same production lot as the production lot of the above-mentioned photosensitive drum A was used. The results are illustrated in FIG. 7.

Figure 7:
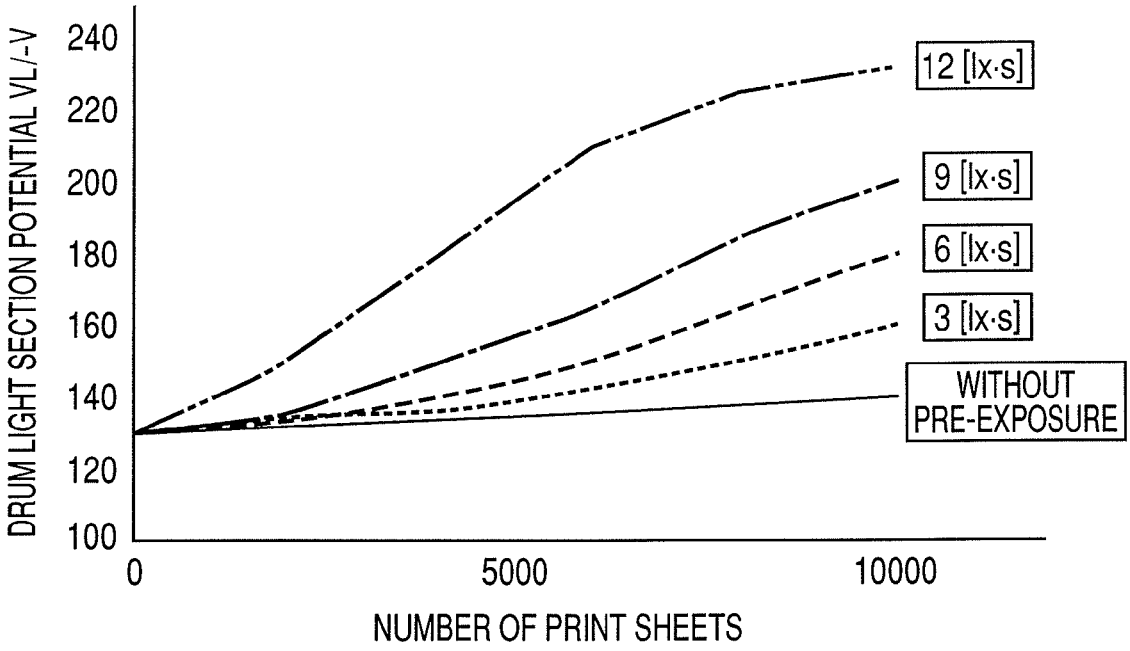
FIG. 7 is a graph illustrating the relationship between the number of printed sheets and drum light section potential.

As illustrated in FIG. 7, when the endurance test (continuous printing) was conducted with a pre-exposure light amount set to be large, the photosensitive drum light section potential VL is changed to a large extent according to the respective endurance. This is because exposure to light for a long time of the photosensitive drum by the pre-exposure with a larger light amount gradually makes a charge to remain thereon, which makes dull the sensitivity of the photosensitive drum. Further, the photosensitive drum light section potential VL without the pre-exposure is changed in the endurance test, because the photosensitive drum film thickness became smaller.

From the results illustrated in FIG. 7, it is found that the smaller the pre-exposure light amount is, the more the deterioration in sensitivity of the photosensitive drum can be suppressed.

From the results above, it is preferred that the pre-exposure light amount be sufficiently large such that a ghost image is prevented from occurring, and at the same time, that the pre-exposure light amount be sufficiently small such that the deterioration in sensitivity of the photosensitive drum is less liable to occur. More specifically, with regard to the above-mentioned drum A, a ghost did not occur if the pre-exposure light amount is 6 [lx·s] or more. The change in the photosensitive drum light section potential VL when 10,000 sheets were printed illustrated in FIG. 7 could be suppressed to about 50% compared with a case where the pre-exposure light amount was 12 [lx·s] when the pre-exposure light amount was 6[lx·s] and to about 67% compared with a case where the pre-exposure light amount was 9 [lx·s] when the pre-exposure light amount was 6[lx·s].

As described above, in order to attain both the prevention of a ghost and the prevention of the deterioration in sensitivity of the photosensitive drum, it is preferred that a smaller pre-exposure light amount in a range where the slopes of the charging current of FIG. 6 are small (in a range where the change in the charging current is small with respect to the change in the pre-exposure light amount) be used.

In the present embodiment, during a time period when no image is formed, while direct current voltage is applied to the charging roller 2 by the charging voltage power source portion 31, based on the results of the detection by the charging current detecting device 32 when the exposure light amount of the pre-exposure device 10 is changed, the exposure light amount of the pre-exposure device 10 in image formation is controlled by the pre-exposure light amount control device 33. More specifically, during a time period when no image is formed, direct current voltage is applied to the charging roller 2 by the charging voltage applying device to charge the photosensitive drum. Then, exposure is carried out with the exposure light amount of the pre-exposure device for the charged photosensitive drum being changed in a plurality of steps, and regions exposed with the different exposure light amounts are formed on the photosensitive drum. Then, the regions of the photosensitive drum exposed with the different exposure light amounts are again charged by the charging roller 2. Here, the amount of charging current is detected by the charging current detecting device 32. Based on the rate of change (slope) of the amount of the charging current detected by the charging current detecting device 32 with the exposure light amount of the pre-exposure device 10 changed, the pre-exposure light amount control device 33 controls the exposure light amount of the pre-exposure device 10 during image formation. The time period when no image is formed is a time period when the photosensitive drum is rotationally driven but the image forming apparatus does not form an image.

In the present embodiment, during a time period when no image is formed, for example, during pre-multi-rotation (during a pre-multi-rotation operation) of the image forming apparatus, with predetermined direct current voltage being applied to the charging roller 2, the pre-exposure light amount of the pre-exposure device 10 is changed in a plurality of steps E(1) to E(5). Here, charging currents (electric currents flowing through the charging roller 2) Ic(1) to Ic(5) are detected by the charging current detecting device 32. More specifically, Ic(1) is a charging current which flows when a region of the photosensitive drum exposed to light with the pre-exposure light amount E(1) is charged by the charging roller 2. Similarly, Ic(2) is a charging current which flows when a region of the photosensitive drum exposed to light with the pre-exposure light amount E(2) is charged. In this way, based on the results of the detection by the charging current detecting device 32, a slope a(n) of the charging current is calculated by the pre-exposure light amount control device 33:

$$a(n) = \frac{Ic(n+1) - Ic(n)}{E(n+1) - E(n)} \quad (n = 1, 2, \cdots, 5)\left[\frac{\mu A}{lx \cdot s}\right]$$

When the value is equal to or smaller than a predetermined value α(X), the pre-exposure light amount in image formation is determined to be E(n).

Here, α(X) is a value of α(n) where a ghost does not occur and the smallest pre-exposure light amount is used. An α(X) is determined in advance for the image forming apparatus. The value of α(X) may be stored in the storage device of the cartridge 13, or may be stored in the main body of the image forming apparatus.

In the present embodiment, during the pre-multi-rotation operation which is a time period when no image is formed, the pre-exposure light amount E(n) in image formation is determined. However, the determination may be made in any time period when no image is formed, for example, during the pre-rotation operation or during the post-rotation operation.

Here, direct current voltage of −1200 V is used as the voltage applied to the charging roller 2. However, the present invention is not limited thereto, and other direct current voltages may be applied. Further, it is sufficient that the number of the steps in which the pre-exposure light amount is changed may be three or more, and is not limited to the above. In the present embodiment, it is assumed that E1=3, E2=6, E3=9, E4=12, and E5=15 [lx·s].

Figure 8:
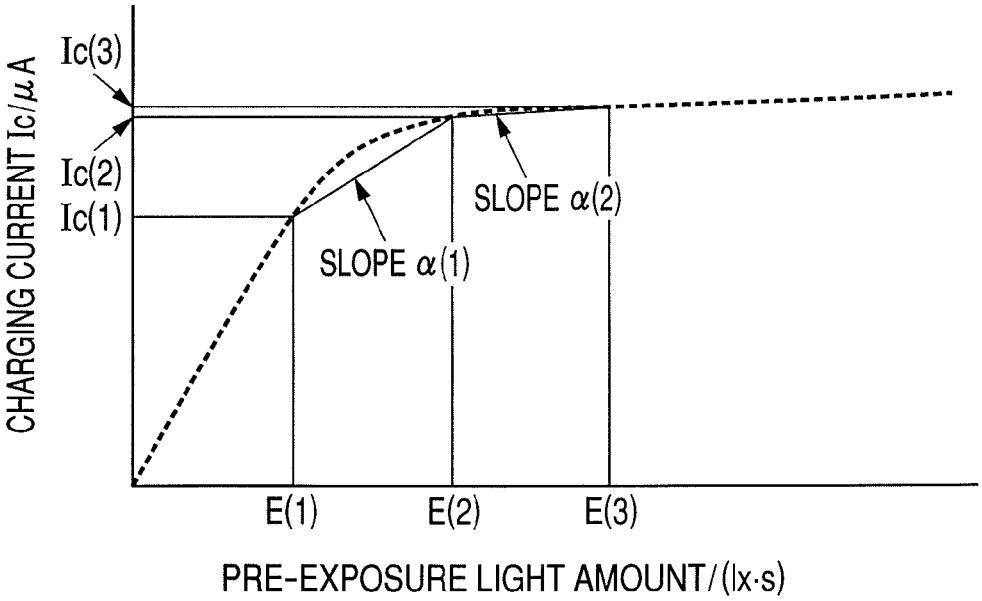
FIG. 8 is a graph describing the relationship between the pre-exposure light amount and the charging current, and a slope $\alpha$.

FIG. 8 illustrates the slope a(n) when the above-mentioned photosensitive drums A, B, and C are used. In order to attain both the prevention of a ghost image and the smallest deterioration in sensitivity of the photosensitive drum with the pre-exposure light amount changed from E1 to E3 by 3 [lx·s] in the respective steps, the following equation is used in the present image forming apparatus:

$$a(X) = 0.2 \left[\frac{\mu A}{lx \cdot s}\right]$$

By using the above-mentioned equation, independent of the photosensitive drum film thickness and the sensitivity of the photosensitive drum, the desired pre-exposure light amount E(n) in image formation can be determined. $\alpha(X)=0.2$ is used in the present embodiment. However, the value of $\alpha(X)$ of course varies depending on a set value of the pre-exposure light amount to be sampled, the number of samples, voltage applied to the charging roller 2, and the like, and therefore $\alpha(X)$ has to be appropriately determined in advance for the image forming apparatus.

Figure 9:
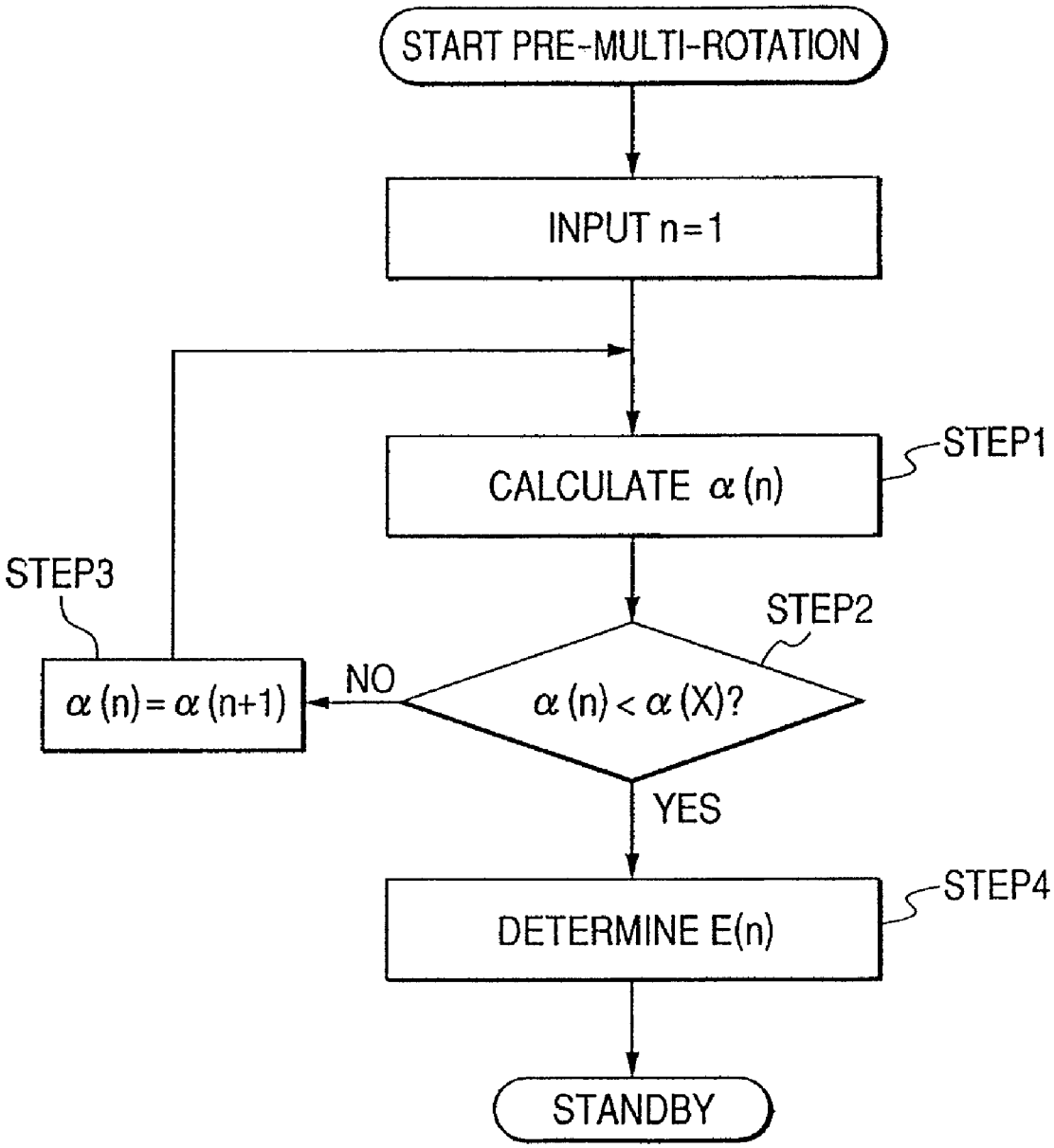
FIG. 9 is a flowchart of pre-exposure control according to the first embodiment of the present invention.

FIG. 9 is a control chart in the pre-exposure light amount control device 33. First, $\alpha(n=1)$ is calculated in Step 1, and the process proceeds to Step 2. Here, whether $\alpha(n)<\alpha(X)$ or not is determined. When the determination is "NO", the process proceeds to Step 3 where n=(n+1) is carried out. Then, again in Step 1, $\alpha(n=1)$ is calculated and the process proceeds to Step 2. When the determination is "YES" in Step 2, the process proceeds to Step 4 where the pre-exposure light amount in image formation is determined to be E(n).

In the present embodiment, the determination is made so as to be E(n)=6 with regard to the above-mentioned photosensitive drums A and B, while the determination is made so as to be E(n)=9 with regard to the photosensitive drum C.

After that, the image forming apparatus is in a standby state and waits for a print job. When the image forming apparatus receives a print job, the image forming apparatus forms an image with the pre-exposure light amount E(n).

The above-mentioned control enables suppressing the occurrence of a ghost image and deterioration in sensitivity of the photosensitive drum.

The present embodiment is characterized in that, based on charging current E(n) which is the smallest pre-exposure light amount in a range where $\alpha(n)$ is smaller than $\alpha(X)$ determined in advance, the pre-exposure light amount in image formation is determined. In the present embodiment, E(n) was determined to be the pre-exposure light amount in image formation as it is. However, insofar as the base is E(n), the present invention is not limited thereto. For example, after it is found that, by carrying out the above-mentioned control, the appropriate exposure light amount is on the order of E(n), the E(n) plus a correction value may be used in image formation as the pre-exposure light amount.

Second Embodiment

In the first embodiment of the present invention, the slope $\alpha(n)$ of the charging current when the pre-exposure light amount is changed, that is, the rate of change of the amount of the charging current is used to determine the pre-exposure light amount. However, in the present embodiment, the determination is made using the value of the charging current as it is when the pre-exposure is changed. Similar to the case of the first embodiment of the present invention, during a time period when no image is formed, direct current voltage is applied to the charging roller 2 by the charging voltage applying device to charge the photosensitive drum. Then, exposure is carried out with the exposure light amount of the pre-exposure device for the charged photosensitive drum being changed in a plurality of steps, and regions exposed with the different exposure light amounts are formed on the photosensitive drum. Then, the regions of the photosensitive drum exposed with the different exposure light amounts are again charged by the charging roller 2. Here, the amount of the charging current is detected by the charging current detecting device 32. Based on the magnitude of the amount of the charging current detected by the charging current detecting device 32 while the exposure light amount of the pre-exposure device 10 is changed, the pre-exposure light amount is controlled.

Compared with the case of the first embodiment of the present invention, control can be exercised more easily in this method, and thus, processing in the pre-exposure light amount control device 33 is carried out faster, and the pre-exposure light amount in image formation can be determined faster.

Other structures and actions are the same as those in the first embodiment of the present invention, and thus, like numerals are used to designate the like or identical members, and a detailed description thereof is omitted.

Pre-exposure light amount control in the present embodiment will now be described. During a time period when no image is formed, for example, during pre-multi-rotation of the image fanning apparatus, with predetermined direct current voltage being applied to the charging roller 2, the pre-exposure light amount is changed in a plurality of steps E(1) to E(5). Here, charging currents Ic(1) to Ic(5) are detected by the charging current detecting device 32. E(n) obtained when the charging current Ic(n) exceeds a predetermined value Ic(X) and the smallest Ic flows is determined to be the pre-exposure light amount in image formation. Ic(X) is a value of Ic where a ghost does not occur and the smallest pre-exposure light amount is used. Ic(X) is determined in advance for the image forming apparatus.

In the present embodiment, during the pre-multi-rotation operation which is the time period when no image is formed, the pre-exposure light amount E(n) in image formation is determined. However, the determination may be made in any time period when no image is formed, for example, during the pre-rotation operation or during the post-rotation operation. Direct current voltage of −1200 V is used as the voltage applied to the charging roller 2. However, the present invention is not limited thereto, and other direct current voltages may be applied. Further, it is sufficient that the number of the steps in which the pre-exposure light amount may be changed is two or more, and is not limited to the above. In the present embodiment, it is assumed that E1=3, E2=6, E3=9, E4=12, and E5=15 [lx·s].

As is clear from FIG. 6, Ic(X) varies depending on the film thickness of the photosensitive drum to be used. When one of the photosensitive drums A and C whose film thicknesses are substantially the same is used, Ic(X)=56 [μA] is set in advance. When the photosensitive drum B whose film thickness is different from the film thicknesses of the photosensitive drums A and C by about 10 μm is used, Ic(X)=115 [μA] is set in advance. The value of Ic(X) of course varies depending on the photosensitive drum to be used, a set value of the pre-exposure light amount to be sampled, the number of samples, voltage applied to the primary charger (charging roller 2), and the like, and thus, Ic(X) has to be appropriately determined in advance for the image forming apparatus.

Figure 10:
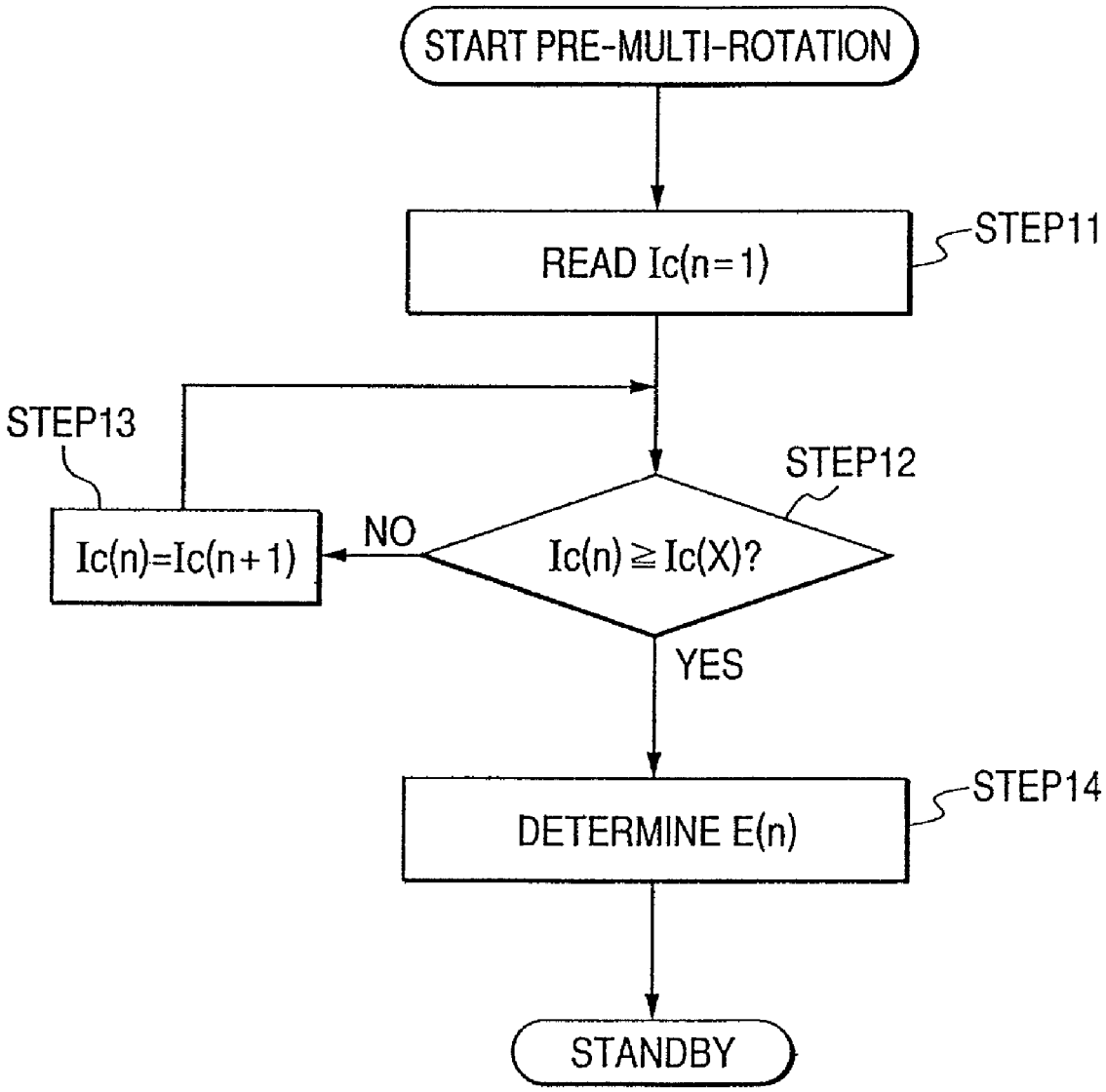
FIG. 10 is a flowchart of the pre-exposure control according to a second embodiment of the present invention.

FIG. 10 is a control chart in the pre-exposure light amount control device 33. Ic(n=1) is read in Step 11, and the process proceeds to Step 12. Here, whether Ic(n)≧Ic(X) or not is determined. When the determination is "NO", the process proceeds to Step 13 where Ic(n+1) is read. Then, the process proceeds to Step 12 again. When the determination in Step 12 is "YES", the process proceeds to Step 14 where the pre-exposure light amount in image formation is determined to be E(n). In the present embodiment, the determination is made so as to be E(n)=6 with regard to the above-mentioned photosensitive drums A and B, while the determination is made so as to be E(n)=9 with regard to the photosensitive drum C.

After that, the image forming apparatus is in a standby state and waits for a print job. When the image forming apparatus receives a print job, the image forming apparatus forms an image with the pre-exposure light amount E(n).

The present embodiment is characterized in that, based on charging current E(n) which is the smallest pre-exposure light amount where charging current equal to or larger than Ic(X) determined in advance is obtained, the pre-exposure light amount in image formation is determined. In the present embodiment, the value of E(n) is determined to be the pre-exposure light amount in image formation as it is. However, insofar as the base is E(n), the present invention is not limited thereto. For example, after it is found that, by carrying out the above-mentioned control, the appropriate exposure light amount is on the order of E(n), the E(n) plus a correction value may be used in image formation as the exposure light amount.

Similar to the case of the first embodiment of the present invention, the above-mentioned control enables suppressing the occurrence of a ghost image and deterioration in sensitivity of the photosensitive drum.

Third Embodiment

In the second embodiment of the present invention, the value of the charging current as it is when the pre-exposure is changed is used to make the determination, and it is described that the value of Ic(X) has to be changed depending on the film thickness of the photosensitive drum to be used. The second embodiment of the present invention has no problem when the film thickness of the photosensitive drum does not become thinner as the printing proceeds, and when, even if the film thickness becomes thinner, the influence is not so significant and it is not necessary to take the film thickness into consideration. However, when the photosensitive drum is gradually shaved off and the film thickness becomes thinner, and the influence is significant, an appropriate exposure light amount may not be obtained with an apparatus where the film thickness of a photosensitive drum thereof has to be taken into consideration. Therefore, in the present embodiment, the pre-exposure light amount E(X) in image formation is determined using the value of Ic(X) which takes into consideration that the electrophotographic photosensitive member 1*b* of the photosensitive drum 1 is gradually shaved off and becomes thinner. More specifically, the results of the detection by the charging current detecting device 32 is corrected based on information with regard to the film thickness of the photosensitive drum 1. The information with regard to the film thickness of the photosensitive drum 1 correlates to, for example, the number of sheets printed by the image forming apparatus (a value of the accumulated number of print sheets printed) and time period when the photosensitive drum 1 is driven (rotated) (a value of the accumulated time).

Other structures and actions are the same as those in the first embodiment and the second embodiment of the present invention, and thus, like numerals are used to designate the like or identical members and a detailed description thereof is omitted.

In the present embodiment, the value of Ic(X) is determined based on the information with regard to the film thickness of the photosensitive drum 1. First, the information with regard to the film thickness of the photosensitive drum is described.

The photosensitive drum is shaved off and its film thickness becomes thinner in proportion to the rotation time of the photosensitive drum. Therefore, in the present embodiment, photosensitive drum rotation time (time instance during which the photosensitive drum is driven) W[s] is used as the information with regard to the film thickness of the photosensitive drum. Strictly speaking, the amount of change of the film thickness of the photosensitive drum slightly differs between a case where the photosensitive drum rotates with voltage applied to the charging roller 2 (with the photosensitive drum being charged) and a case where the photosensitive drum rotates with no voltage applied thereto. Therefore, weights may be assigned by, for example, the following equation:

$$W=Pt+\beta Dt \text{ (}\beta\text{ is a constant which varies depending on specifications of image forming apparatus),}$$

where Pt is time instance during which the photosensitive drum rotates while being charged and Dt is time during which the photosensitive drum rotates while no charge is applied thereto.

In the present embodiment, weights are not assigned between Dt and Pt. In other words, β=1 and W=Pt+Dt.

Figure 11:
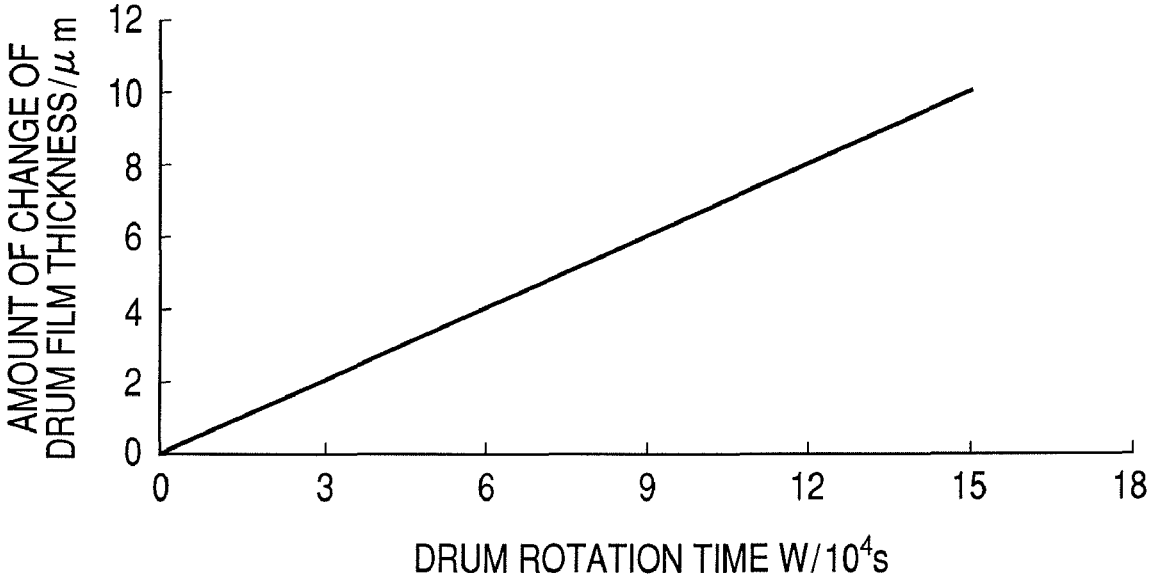
FIG. 11 is a graph illustrating the relationship between drum rotation time and an amount of change of drum film thickness.

FIG. 11 illustrates the relationship between a photosensitive drum rotation time W and an amount of change of the film thickness of the photosensitive drum. The photosensitive drum is shaved off and becomes thinner in proportion to W. It can be seen that the amount of change of the film thickness is about 2 μm for every $3\times10^4$[s] change in W.

Here, pre-exposure light amount control in the present embodiment is described. During a time period when no image is formed, for example, during pre-multi-rotation, with predetermined direct current voltage being applied to the charging roller 2, the pre-exposure light amount is changed in a plurality of steps E(1) to E(5). Here, charging currents Ic(1) to Ic(5) are detected by the charging current detecting device 32. E(n) obtained when the charging current Ic(n) exceeds a predetermined value Ic(X) and the smallest Ic flows is determined to be the pre-exposure light amount in image formation.

In the present embodiment, during the pre-multi-rotation operation which is a time period when no image is formed, the pre-exposure light amount E(n) in image formation is determined. However, the determination may be made in any time period when no image is formed, for example, during the pre-rotation operation or during the post-rotation operation. Direct current voltage of −1200 V is used as the voltage applied to the charging roller 2. However, the present invention is not limited thereto, and other direct current voltages may be applied. Further, it is sufficient that the number of the steps in which the pre-exposure light amount is changed may be two or more, and is not limited to the above. In the present embodiment, it is assumed that E1=3, E2=6, E3=9, E4=12, and E5=15 [lx·s].

From the results illustrated in FIG. 6 with regard to the photosensitive drums A and B whose film thicknesses are different from each other by about 10 μm, in the image forming apparatus of the present embodiment, the value of Ic(X) is increased by 6 μA every time the photosensitive drum film thickness becomes thinner by 1 μm, that is, for every $1.5\times10^4$ [s] increase in W. The correction amount of course varies depending on the photosensitive drum to be used, a set value of the pre-exposure light amount to be sampled, the number of samples, voltage applied to the primary charger (charging roller 2), and the like, and thus, the correction amount has to be appropriately determined in advance for the image forming apparatus. In the present embodiment, from the results illustrated in FIG. 11, it is found that the photosensitive drum is shaved off by 1 μm when $W=1.5\times10^4$ [s].

Accordingly, in the present embodiment, the following is set:

$$Ic(X) = Ico + 6 \times \frac{W}{1.5\times10^4}[\mu A]$$

where Ico corresponds to Ic(X) in the second embodiment of the present invention, and is a value of Ic where a ghost does not occur and the smallest pre-exposure light amount is used when a new photosensitive drum is used. In the present embodiment, Ico=56 [μA] is set in advance when one of the photosensitive drum A and C is used, while Ico=115 [μA] is set in advance when the photosensitive drum B is used.

The photosensitive drum rotation time W is calculated by the photosensitive drum rotation information calculating device 34 and is stored in the storage device 12 as occasion arises.

Figure 12:
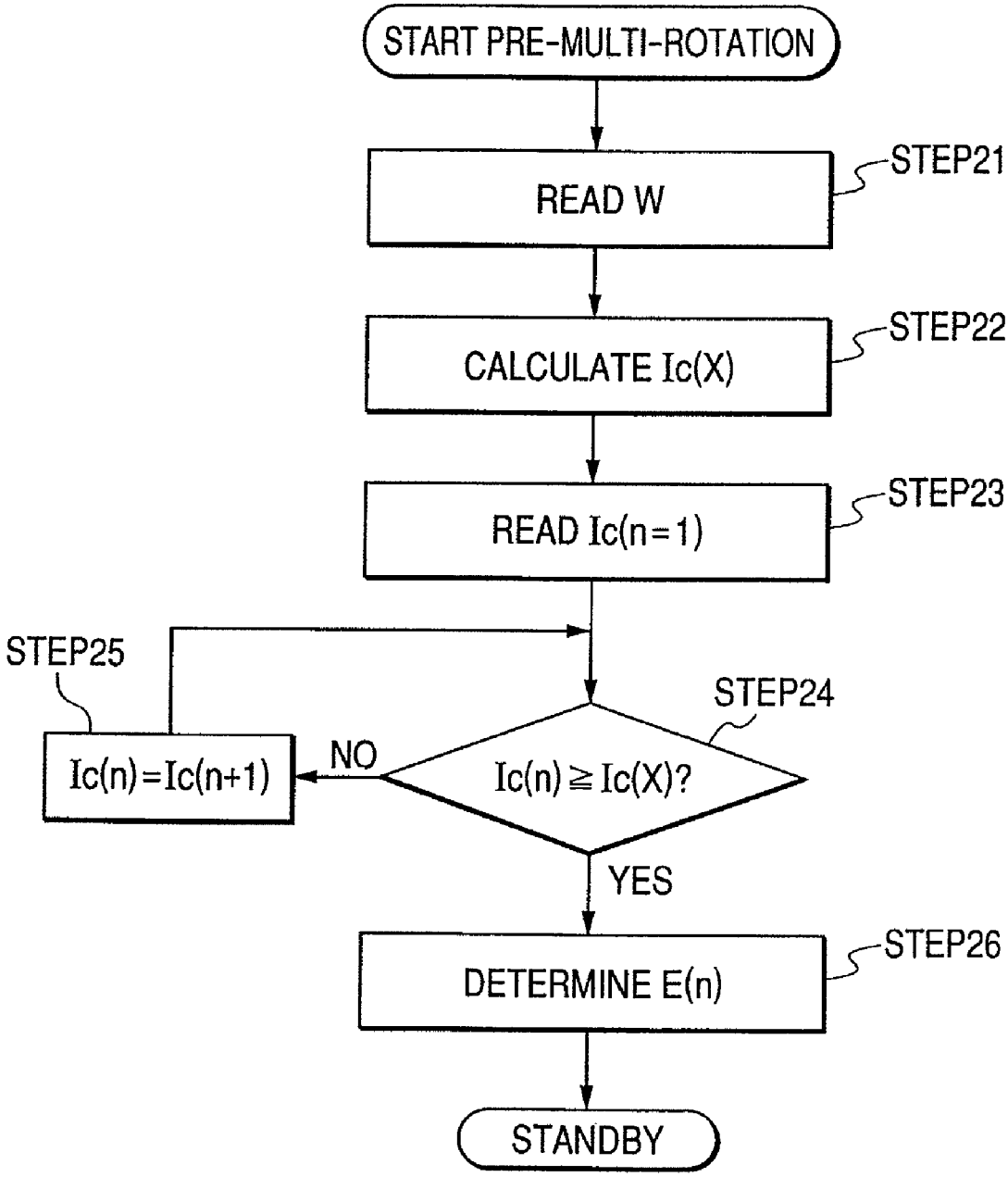
FIG. 12 is a flowchart of pre-exposure control according to a third embodiment of the present invention.

FIG. 12 is a control chart in the pre-exposure light amount control device 33. W stored in the storage device 12 is read in Step 21. Ic(X) is calculated in Step 22. Then, in Step 23, Ic(n=1) is read. In Step 24, whether Ic(n)≧Ic(X) or not is determined. When the determination is "NO", the process proceeds to Step 25 where Ic(n+1) is read. Then, the process proceeds to Step 24 again. When the determination in Step 24 is "YES", the process proceeds to Step 26 where the pre-exposure light amount in image formation is determined to be E(n). In the present embodiment, the determination is made so as to be E(n)=6 with regard to the photosensitive drums A and B, while the determination is made so as to be E(n)=9 with regard to the photosensitive drum C.

After that, the image forming apparatus is in a standby state and waits for a print job. When the image forming apparatus receives a print job, the image forming apparatus forms an image with the pre-exposure light amount E(n).

As the information with regard to the film thickness of the photosensitive drum 1, the number of printed sheets (a value of the accumulated number of printed sheets) printed by the image forming apparatus) may also be used. In this case, the number of sheets printed by the image forming apparatus is counted by a sheet counter device (not shown) and is stored in the storage device 12 as occasion arises. Then, similar to the case of the time during which the photosensitive drum is driven, the value of Ic(X) is increased by 6 μA every time the number of sheets printed reaches the number of sheets printed by which the photosensitive drum film thickness becomes thinner by 1 μm.

In the first to third embodiments of the present invention, the contact charging member is not limited to one having the shape of the charging roller 2, and it may be an non-rotational conductive member including blade-like, rod-like, sheet-like, and block-like ones, or a rotational or non-rotational conductive fur brush member or magnetic brush member.

As described above, during a time period when no image is formed including the time period when the pre-multi-rotation is carried out, the charging current is detected with the pre-exposure light amount being changed. Based on the results, the pre-exposure light amount in image formation can be optimally determined. This enables providing an image forming apparatus which can suppress a ghost to maintain satisfactory image quality, which can suppress deterioration in sensitivity of a photosensitive drum therein, and with which stable density and gradations can be obtained for a long time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-185638, filed Jul. 17, 2007 and No. 2008-142353, filed May 30, 2008, which are hereby incorporated by reference herein in their entirety.

What is claimed is:

1. An image forming apparatus comprising:

an electrophotographic photosensitive member;

a contact charging member being in contact with the electrophotographic photosensitive member, for charging the electrophotographic photosensitive member;

a charging voltage applying device for applying a direct current voltage to the contact charging member;

a charging current detecting device for detecting an electric current flowing through the contact charging member;

a pre-exposure device for exposing the electrophotographic photosensitive member to light to remove residual charge on the electrophotographic photosensitive member; and a control device for controlling an exposure light amount of the pre-exposure device, wherein the control device applies the direct current voltage from the charging voltage applying device to the contact charging member during a non-image formation to charge the electrophotographic photosensitive member, changes in a plurality of steps the exposure light amount of the pre-exposure device for the charged electrophotographic photosensitive member to form regions of the electrophotographic photosensitive member exposed with different exposure light amounts, and, based on a result of detection by the charging current detecting device when the regions of the electrophotographic photosensitive member exposed with the different exposure light amounts are charged by the contact charging member, the control device controls an exposure light amount of the pre-exposure device in an image formation.

2. An image forming apparatus according to claim 1, wherein the control device controls the exposure light amount of the pre-exposure device in the image formation based on a rate of change of an amount of a charging current detected by the charging current detecting device.

3. An image forming apparatus according to claim 2, wherein the control device controls the exposure light amount of the pre-exposure device in the image formation according to a charging current corresponding to a smallest exposure light amount of exposure light amounts each obtaining a charging current the rate of change of which is smaller than a predetermined value.

4. An image forming apparatus according to claim 1, wherein the control device controls the exposure light amount of the pre-exposure device in the image formation based on a magnitude of an amount of a charging current detected by the charging current detecting device.

5. An image forming apparatus according to claim 4, wherein the control device controls the exposure light amount of the pre-exposure device in the image formation according to a charging current corresponding to a smallest exposure light amount of exposure light amounts each obtaining a charging current the magnitude of which is larger than a predetermined value.

6. An image forming apparatus according to claim 1, wherein, based on information with regard to a film thickness of the electrophotographic photosensitive member in addition to the result of detection by the charging current detecting device, the control device controls the exposure light amount of the pre-exposure device in the image formation.

7. An image forming apparatus according to claim 6, wherein the information with regard to a film thickness of the electrophotographic photosensitive member is the number of print sheets printed by the image forming apparatus.

8. An image forming apparatus according to claim 6, wherein the information with regard to a film thickness of the electrophotographic photosensitive member is a time during which the electrophotographic photosensitive member is driven.

9. An image forming apparatus according to claim 1, wherein the control device controls the exposure light amount of the pre-exposure device by changing a voltage or an electric current which is input to the pre-exposure device.

10. An image forming apparatus according to claim 1, wherein the control device controls the exposure light amount of the pre-exposure device by changing a pulse width of the voltage which is input to the pre-exposure device.

* * * * *